US005876890A

United States Patent [19]

Kitamura et al.

[11] Patent Number: 5,876,890

[45] Date of Patent: Mar. 2, 1999

[54] ELECTROPHOTOGRAPHIC PHOTOSENSITIVE MEMBER AND APPARATUS AND PROCESS CARTRIDGE PROVIDED WITH THE SAME

[75] Inventors: Wataru Kitamura, Matsudo; Hidetoshi Hirano, Shizuoka-ken; Kimihiro Yoshimura, Yokohama, all of Japan

[73] Assignee: Canon Kabushiki Kaisha, Tokyo, Japan

[21] Appl. No.: 863,046

[22] Filed: May 23, 1997

[30] Foreign Application Priority Data

May 27, 1996 [JP] Japan ..... 8-132459

[51] Int. Cl.[6] ..... G03G 5/05

[52] U.S. Cl. ..... 430/59; 430/96; 399/148

[58] Field of Search ..... 430/58, 59, 96; 399/148

[56] References Cited

U.S. PATENT DOCUMENTS

| | | | |
|---|---|---|---|
| 3,837,851 | 9/1974 | Shattuck et al. | 96/1.5 |
| 3,871,880 | 3/1975 | Montillier | 96/1.5 |
| 5,332,635 | 7/1994 | Tanaka | 430/96 |
| 5,352,552 | 10/1994 | Maruyama et al. | 430/66 |
| 5,538,826 | 7/1996 | Ainoya et al. | 430/58 |
| 5,565,289 | 10/1996 | Yoshihara et al. | 430/64 |
| 5,667,926 | 9/1997 | Maruyama et al. | 430/97 |

FOREIGN PATENT DOCUMENTS

| | | |
|---|---|---|
| 0504794 | 9/1992 | European Pat. Off. . |
| 0608562 | 8/1994 | European Pat. Off. . |

(List continued on next page.)

*Primary Examiner*—John Goodrow
*Attorney, Agent, or Firm*—Fitzpatrick, Cella Harper & Scinto

[57] ABSTRACT

A surface layer of a photosensitive layer contains a resin comprising a structural unit represented by the following general formula (1), and at least one compound of a triarylamine compound represented by the following general formula (2) and a styryl compound represented by the following general formula (3):

(1)

wherein, X is —$CR_{13}R_{14}$—, substituted or unsubstituted cycloalkylidene, substituted or unsubstituted α,ω-alkylene, single bond, —O—, —S—, —SO— or —$SO_2$—, wherein $R_{13}$ and $R_{14}$ are each hydrogen, trifluoromethyl, or substituted or unsubstituted alkyl or aryl, and $R_1$ to $R_{12}$ are each hydrogen, halogen, or substituted or unsubstituted alkyl or aryl;

(2)

wherein Y is hydrogen, halogen, substituted or unsubstituted alkyl or alkoxy, or wherein $R_{15}'$ to $R_{24}'$ are each hydrogen, halogen, substituted or unsubstituted alkyl or alkoxy, $R_{15}$ to $R_{27}$ are each hydrogen, halogen, substituted or unsubstituted alkyl or alkoxy, and $R_{28}$ and $R_{29}$ are each hydrogen or substituted or unsubstituted alkyl, aralkyl or aryl;

(3)

wherein Z is —$CH_2CH_2$— or —CH=CH—, $R_{30}$ and $R_{31}$ are each substituted or unsubstituted alkyl, aralkyl, aryl or heterocyclic, $R_{32}$ to $R_{39}$ are each hydrogen, substituted or unsubstituted alkyl or alkoxy, and Ar is substituted or unsubstituted arylene or heterocyclic.

9 Claims, 1 Drawing Sheet

FOREIGN PATENT DOCUMENTS

| | | |
|---|---|---|
| 0645680 | 3/1995 | European Pat. Off. . |
| 56-166759 | 12/1981 | Japan . |
| 57-178267 | 11/1982 | Japan . |
| 57-195767 | 12/1982 | Japan . |
| 58-40566 | 3/1983 | Japan . |
| 61-228453 | 10/1986 | Japan . |
| 61-272754 | 12/1986 | Japan . |
| 62-208054 | 9/1987 | Japan . |
| 63-149668 | 6/1988 | Japan . |
| 63-225660 | 9/1988 | Japan . |

ELECTROPHOTOGRAPHIC PHOTOSENSITIVE MEMBER AND APPARATUS AND PROCESS CARTRIDGE PROVIDED WITH THE SAME

BACKGROUND OF THE INVENTION

1. Field of the Invention

The present invention relates to electrophotographic photosensitive members, process cartridges and electrophotographic apparatuses. In particular, the present invention relates to an electrophotographic photosensitive member, a process cartridge and electrophotographic apparatus provided with a photosensitive layer containing a specified resin and charge transfer material.

2. Description of the Related Art

Recently, various electrophotographic photosensitive members containing organic photoconductive materials have been intensively developed. For example, U.S. Pat. No. 3,837,851 discloses a photosensitive member having a charge transfer layer containing triallylpyrazoline, and U.S. Pat. No. 3,871,880 discloses a photosensitive member comprising a charge generating layer containing a perylene pigment derivative and a charge transfer layer containing a condensation product of 3-propylene and formaldehyde.

Organic photoconductive materials are sensitive to their characteristic wavelength ranges. For example, Japanese Unexamined Patent Publication Nos. 61-272754 and 56-167759 disclose compounds highly sensitive to visible light, and Japanese Unexamined Patent Publication Nos. 57-195767 and 61-228453 disclose compounds highly sensitive to an infrared region. Among them, compounds highly sensitive to an infrared region have been increasingly used in laser beam printers (hereinafter referred to as LBP) and LED printers.

Meanwhile, electrophotographic photosensitive members must be provided with sensitivity, electrical characteristics, mechanical properties and optical characteristics suitable for the electrophotographic processes employed. In particular, electrophotographic photosensitive members must be durable against repeated electrical and mechanical forces, such as charging, exposure, development, transfer and cleaning, directly applied to their surfaces. In particular, they must have high electric and mechanical resistance to deterioration due to ozone and nitrogen oxides forming during charging, and surface abrasion occurring during discharging and cleaning.

Another problem to be solved is a phenomenon called "photomemory" in which a residual carrier on the light irradiated section forms a potential difference with the nonlight irradiated section.

Contact charging processes, in which a charging member comes in contact with an electrophotographic photosensitive member and the electrophotographic photosensitive member is charged by applying a voltage to the charging member, have been increasingly employed, as disclosed in Japanese Unexamined Patent Publication Nos. 57-178267 and 58-40566, and cause new problems. Contact charging processes have some technical and economical advantages as compared to scorotrons; for example, extremely low ozone formation, and low electricity consumption (in scorotrons, approximately 80% of current applied to a wire of the charger flows to a shield of the charger).

However, contact of the charging member with an electrophotographic photosensitive member requires a higher mechanical strength for the electrophotographic photosensitive member. Further, use of an input voltage, in which an AC voltage is superposed on a DC voltage, is proposed in order to improve charging stability of the contact charging processes due to electric discharge (Japanese Unexamined Patent Publication No. 63-149668).

Superposition of an AC voltage drastically increases the current flow in the electrophotographic photosensitive member concurrently with improvement in charging stability, and thus causes increased damage or abrasion of the electrophotographic photosensitive member. Therefore, electrical durability, as well as mechanical strength, are required for electrophotographic photosensitive members.

Also, high resistance to solvent cracks formed by adhesion of mechanical oil and finger grease are essential for electrophotographic photosensitive members.

SUMMARY OF THE INVENTION

It is an object of the present invention to provide an electrophotographic photosensitive member having excellent electrical and mechanical durability, and high solvent crack resistance.

It is another object of the present invention to provide a process cartridge and electrophotographic apparatus provided with the electrophotographic photosensitive member set forth above.

The electrophotographic photosensitive member in accordance with the present invention comprises a substrate and a photosensitive layer formed thereon, a surface layer of the photosensitive layer containing (a) a resin comprising a structural unit represented by the following general formula (1), and (b) at least one compound of (i) a triarylamine compound represented by the following general formula (2) or (ii) a styryl compound represented by the following general formula (3):

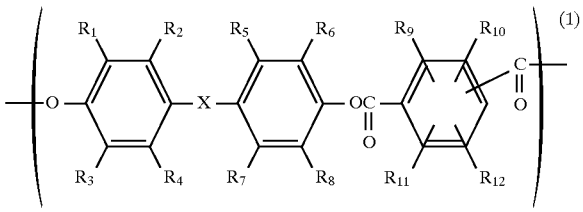

(1)

wherein, X is $—CR_{13}R_{14}—$, substituted or unsubstituted cycloalkylidene, substituted or unsubstituted α,ω-alkylene, single bond, —O—, —S—, —SO— or $—SO_2—$, wherein $R_{13}$ and $R_{14}$ are each hydrogen, trifluoromethyl, or substituted or unsubstituted alkyl or aryl and are the same or different, and $R_1$ to $R_{12}$ are each hydrogen, halogen, or substituted or unsubstituted alkyl or aryl, and are the same or different;

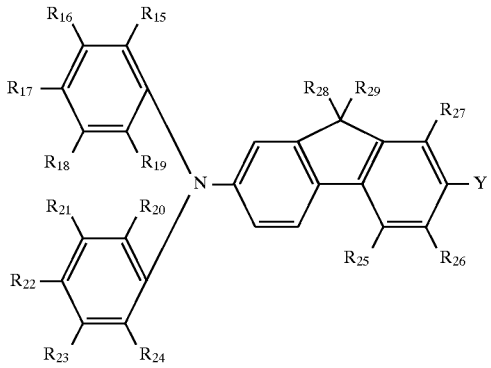

(2)

wherein Y is hydrogen, halogen, substituted or unsubstituted alkyl or alkoxy, or

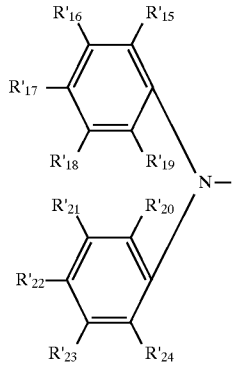

wherein $R_{15}'$ to $R_{24}'$ are each hydrogen, halogen, substituted or unsubstituted alkyl or alkoxy and are the same or different, $R_{15}$ to $R_{27}$ are each hydrogen, halogen, substituted or unsubstituted alkyl or alkoxy and are the same or different, and $R_{28}$ and $R_{29}$ are each hydrogen or substituted or unsubstituted alkyl, aralkyl or aryl, and are the same or different;

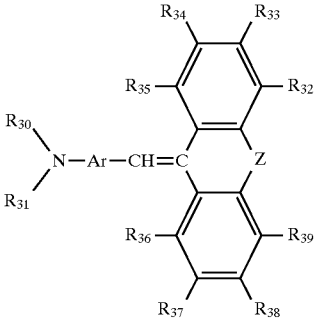

(3)

wherein Z is $—CH_2CH_2—$ or —CH═CH—, $R_{30}$ and $R_{31}$, are each substituted or unsubstituted alkyl, aralkyl, aryl or heterocyclic and are the same or different, $R_{32}$ to $R_{39}$ are each hydrogen, substituted or unsubstituted alkyl or alkoxy and are the same or different, and Ar is substituted or unsubstituted arylene or heterocyclic.

In accordance with other aspects of the present invention, a process cartridge and an electrophotographic photosensitive member include the electrophotographic apparatus set forth above.

DETAILED DESCRIPTION OF THE PREFERRED EMBODIMENTS

Figure 1:
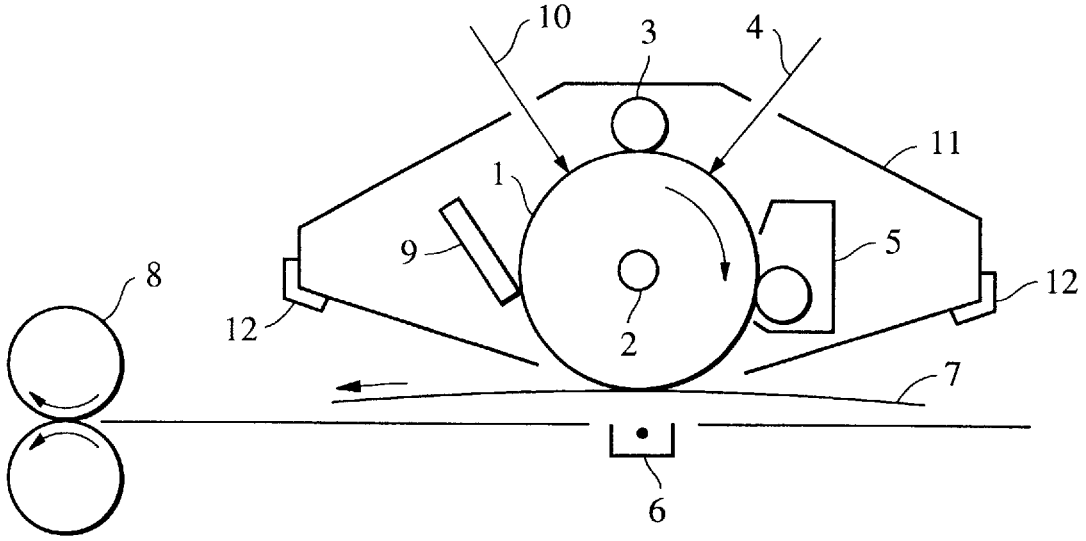
FIG. 1 is a schematic cross-sectional view illustrating an example of an electrophotographic apparatus provided with a process cartridge using an electrophotographic photosensitive member in accordance with the present invention.

The electrophotographic photosensitive member in accordance with the present invention comprises a substrate and a photosensitive layer formed thereon. A surface layer of the photosensitive layer contains (a) a resin comprising a structural unit represented by the following general formula (1), and (b) at least one compound of (i) a triarylamine compound represented by the following general formula (2) or (ii) a styryl compound represented by the following general formula (3):

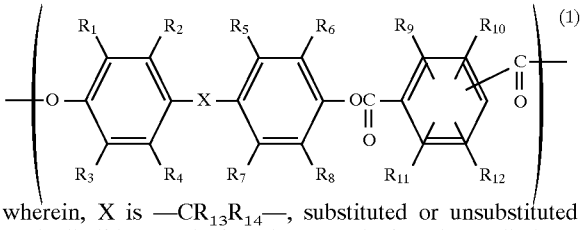

(1)

wherein, X is $—CR_{13}R_{14}—$, substituted or unsubstituted cycloalkylidene, substituted or unsubstituted a, -alkylene, single bond, —O—, —S—, —SO— or $—SO_2—$, wherein $R_{13}$ and $R_{14}$ are each hydrogen, trifluoromethyl, or substituted or unsubstituted alkyl or aryl and are the same or different, and "single bond" means a direct bond between both rings at right and left sides in the compound, such as Structural Units (1)-7, (1)-23 and (1)-24 represented below), and $R_1$ to $R_{12}$ are each hydrogen, halogen, or substituted or unsubstituted alkyl or aryl, and are the same or different;

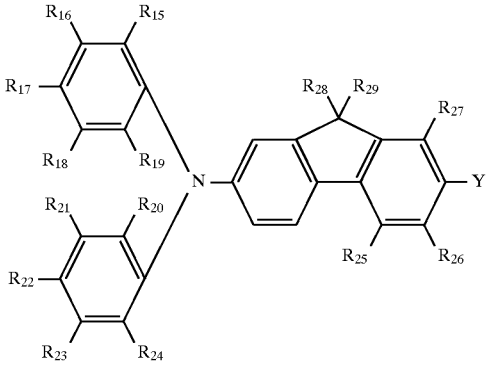

(2)

wherein Y is hydrogen, halogen, substituted or unsubstituted alkyl or alkoxy, or

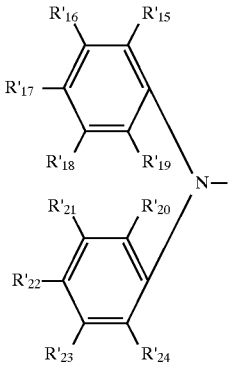

wherein $R_{15}'$ to $R_{24}'$ are each hydrogen, halogen, substituted or unsubstituted alkyl or alkoxy and are the same or different, $R_{15}$ to $R_{27}$ are each hydrogen, halogen, substituted or unsubstituted alkyl or alkoxy and are the same or different, and $R_{28}$ and $R_{29}$ are each hydrogen or substituted or unsubstituted alkyl, aralkyl or aryl, and are the same or different;

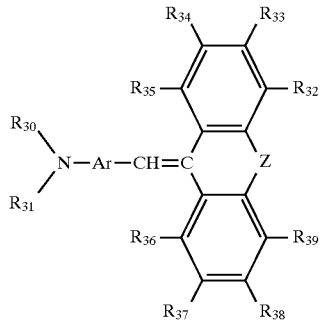

(3)

wherein Z is —$CH_2CH_2$— or —CH═CH—, $R_{30}$ and $R_{31}$ are each substituted or unsubstituted alkyl, aralkyl, aryl or heterocyclic and are the same or different, $R_{32}$ to $R_{39}$ are each hydrogen, substituted or unsubstituted alkyl or alkoxy and are the same or different, and Ar is substituted or unsubstituted arylene or heterocyclic.

The alkyl groups represented in the general formula (1) are preferably lower alkyl and cycloalkyl, such as methyl, ethyl, propyl, cyclohexyl or cycloheptyl. The aryl group in the general formula (1) is preferably phenyl, naphthyl or anthryl. The cycloalkylidene groups in the general formula (1) preferably have from 5 to 11 carbon atoms and more preferably include cylohexylidene, cycloheptylidene and fluorenylidene. The α,ω-alkylene groups preferably have from 2 to 10 carbon atoms and more preferably include 1,2-ethylene, 1,3-propylene, and 1,4-butylene. The halogen atoms include fluorine, chlorine, and bromine. The substitents for the groups set forth above include halogen, such as fluorine, chlorine and bromine; alkyl, such as methyl, ethyl and propyl; aryl, such as phenyl, naphthyl and anthryl; aralkyl, such as benzyl and phenethyl; and alkoxy, such as methoxy, ethoxy and propoxy. The halogen atom and alkyl, aralkyl and aryl groups represented in the general formula (2) are the same as those as in the general formula (1). The arylene groups in the general formula (2) include phenylene, naphthylene, and biphenylene. The heterocyclic groups include pyridine, furan, thiophene and quinoline rings. The substituents for these groups include halogen, alkyl, aryl, aralkyl, and alkoxy as in the general formula (1).

Non limiting preferred examples of the structural units represented by the general formula (1) are as follows:

Structural Unit (1)-1:

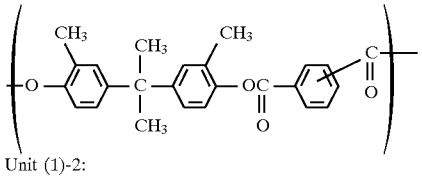

Structural Unit (1)-2:

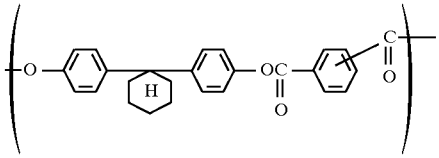

-continued

Structural Unit (1)-3:

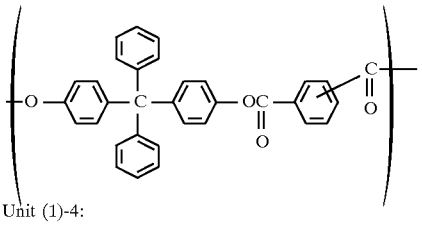

Structural Unit (1)-4:

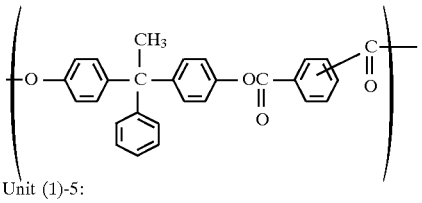

Structural Unit (1)-5:

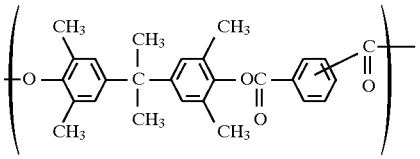

Structural Unit (1)-6:

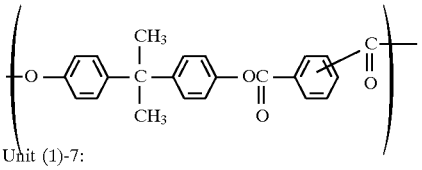

Structural Unit (1)-7:

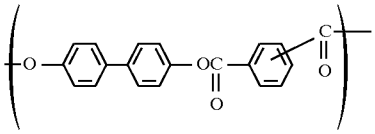

Structural Unit (1)-8:

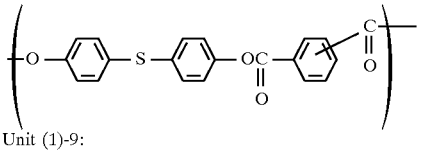

Structural Unit (1)-9:

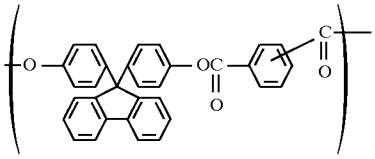

Structural Unit (1)-10:

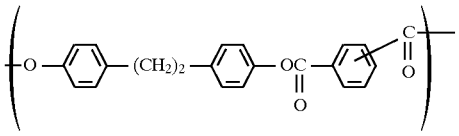

Structural Unit (1)-11:

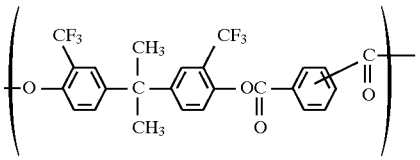

-continued

Structural Unit (1)-12:

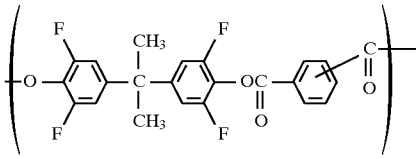

Structural Unit (1)-13:

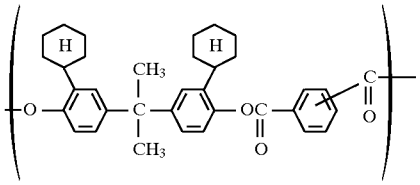

Structural Unit (1)-14:

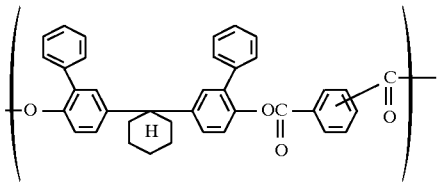

Structural Unit (1)-15:

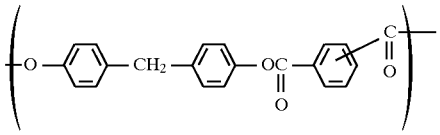

Structural Unit (1)-16:

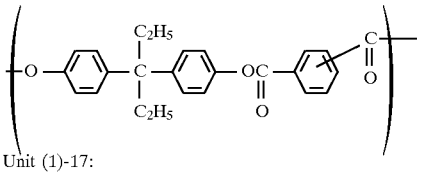

Structural Unit (1)-17:

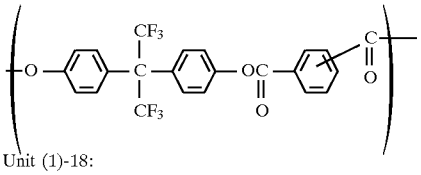

Structural Unit (1)-18:

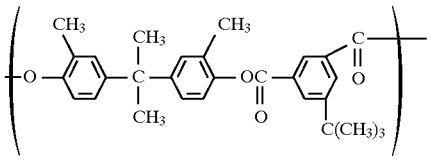

Structural Unit (1)-19:

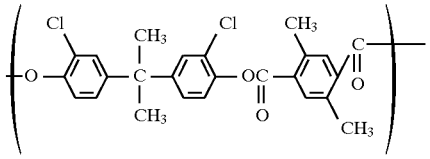

-continued

Structural Unit (1)-20:

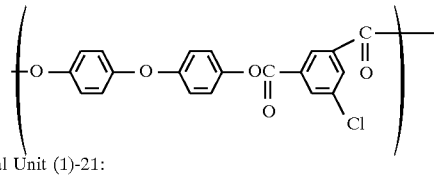

Structural Unit (1)-21:

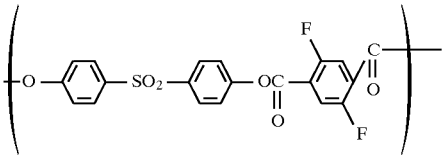

Structural Unit (1)-22:

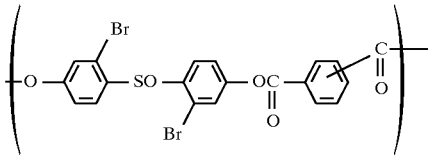

Structural Unit (1)-23:

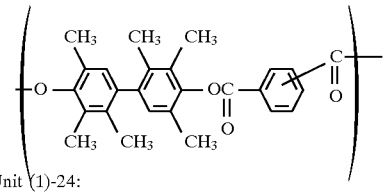

Structural Unit (1)-24:

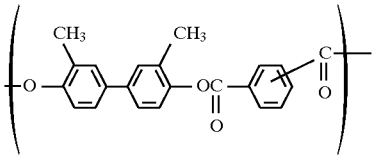

Among them, Structural Units (1)-1, (1)-2 and (1)-3 are more preferable in view of enhanced mechanical strength and compatibility with a charge transfer material, and Structural Units (1)-1 and (1)-2 are most preferable. Further, copolymers including Structural Units (1)-1 and (1)-2 are preferred.

The resin comprising a structural unit represented by the general formula (1) can be prepared by interfacial polymerization of bisphenol represented by the following general formula (4) in an alkaline solvent/water reaction system in the presence of a mixture of terephthalyl chloride and isophthalyl chloride which is added in order to increase the solubility of the bisphenol:

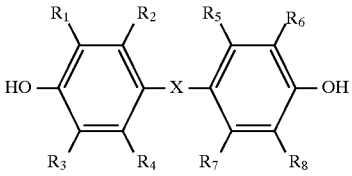

(4)

wherein X and $R_1$ to $R_8$ are the same as those in the general formula (1).

The ratio of terephthalyl chloride to isophthalyl chloride in the mixture is determined in view of solubility of the resin employed, and preferably is 1/1 in ordinary reaction systems, because the solubility of the resulting resin may greatly decrease when either chloride is not greater than 30 mol % of the total chlorides.

The resin in accordance with the present invention may have only one type or two or more types of structural units represented by the general formula (1). The resin may further have other structural units so long as advantages of the present invention do not deteriorate. Two or more kinds of resins each comprising a structural unit represented by the general formula may be used as a blend. Further a blend of at least one resin in accordance with the present invention with other resins may be used.

The resin used in the present invention preferably has a viscosity average molecular weight of 5,000 to 200,000, and more preferably 10,000 to 100,000.

Preferred examples of triarylamine compounds represented by the general formula (2) are as follows, but are not to limited to:

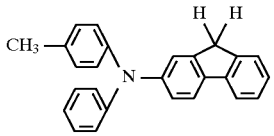

Triarylamine (2)-1

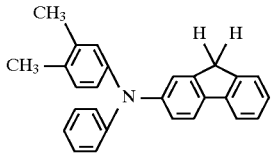

Triarylamine (2)-2

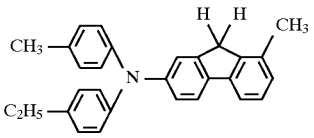

Triarylamine (2)-3

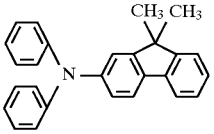

Triarylamine (2)-4

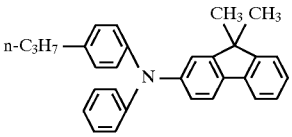

Triarylamine (2)-5

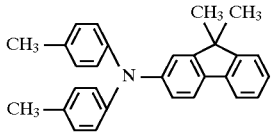

Triarylamine (2)-6

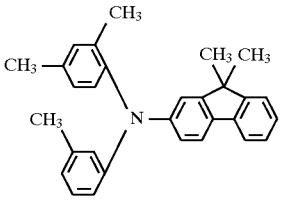

Triarylamine (2)-7

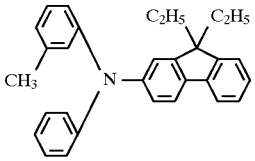

Triarylamine (2)-8

-continued

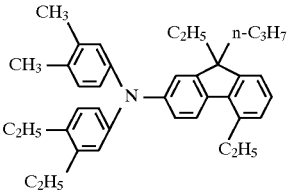

Triarylamine (2)-9

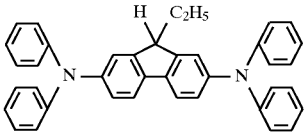

Triarylamine (2)-10

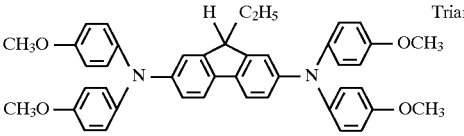

Triarylamine (2)-11

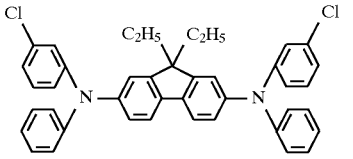

Triarylamine (2)-12

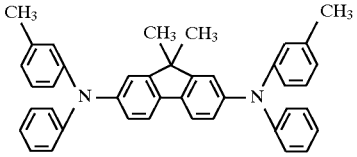

Triarylamine (2)-13

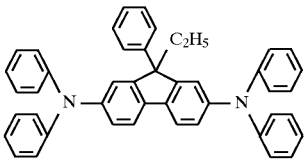

Triarylamine (2)-14

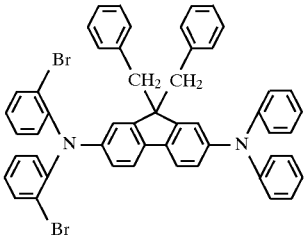

Triarylamine (2)-15

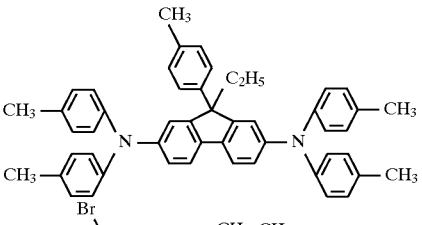

Triarylamine (2)-16

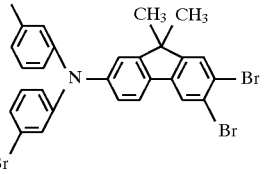

Triarylamine (2)-17

Among them, Triarylamine (2)-4, (2)-6 and (2)-13 are more preferable in view of enhanced sensitivity and compatibility with the resin set forth above, and Triarylamine (2)-6 is most preferable. These triarylamine compounds can be synthesized by a method, for example, described in Japanese Unexamined Patent Publication No. 62-208054.

Examples of preferred styryl compounds represented by the general formula (3) are as follows, but are not limited to:

Styryl Compound (3)-1

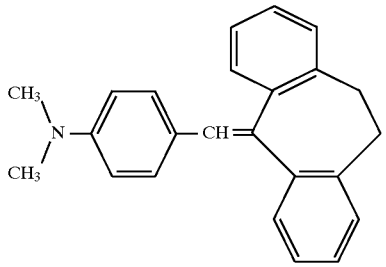

Styryl Compound (3)-2

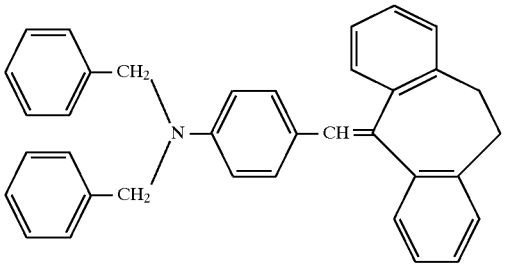

Styryl Compound (3)-3

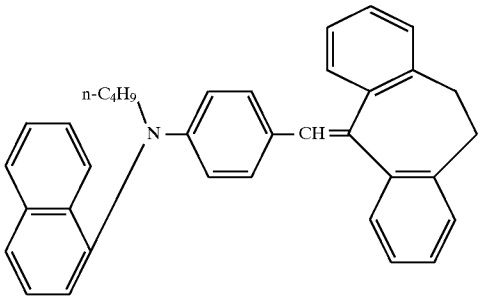

Styryl Compound (3)-4

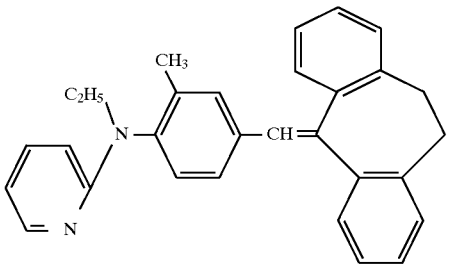

-continued

Styryl Compound (3)-5

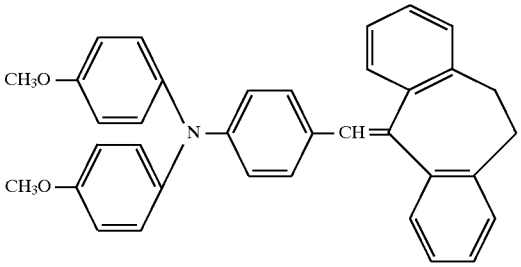

Styryl Compound (3)-6

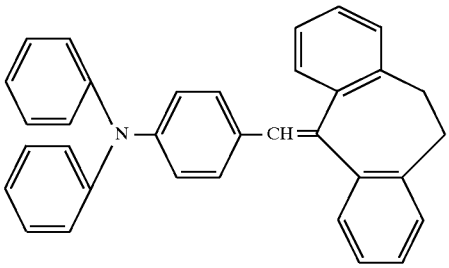

Styryl Compound (3)-7

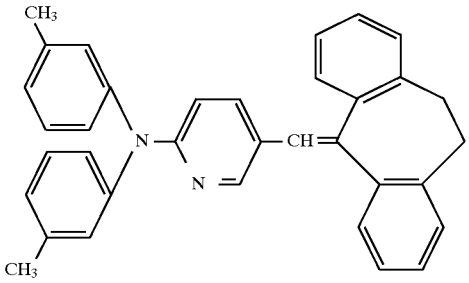

Styryl Compound (3)-8

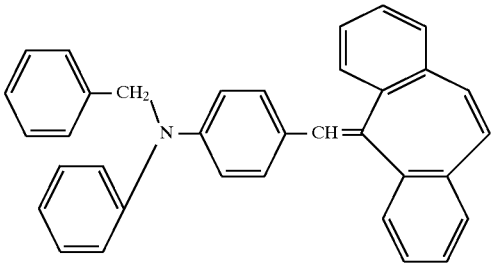

Styryl Compound (3)-9

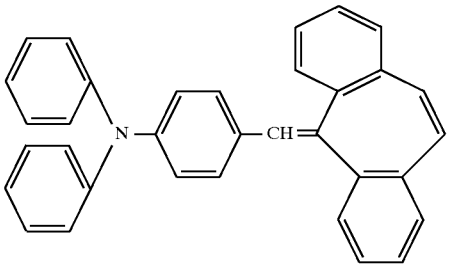

-continued

Styryl Compound (3)-10

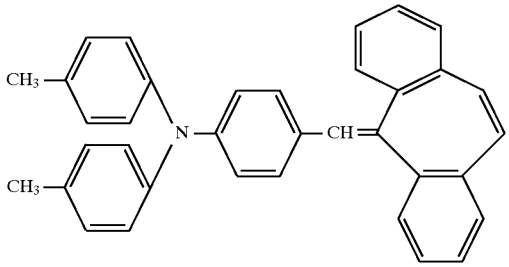

Styryl Compound (3)-11

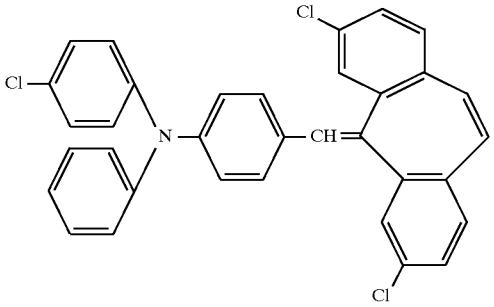

Styryl Compound (3)-12

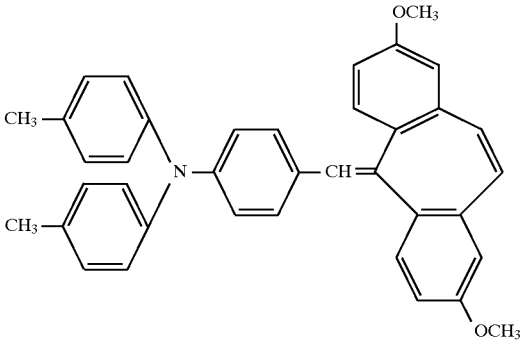

Styryl Compound (3)-13

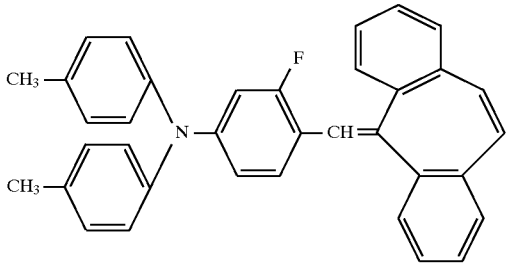

Styryl Compound (3)-14

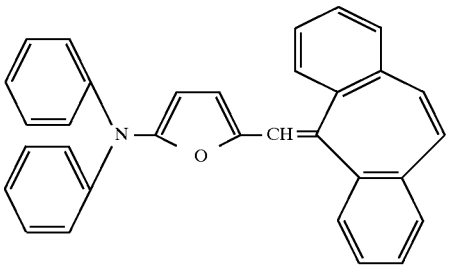

-continued

Styryl Compound (3)-15

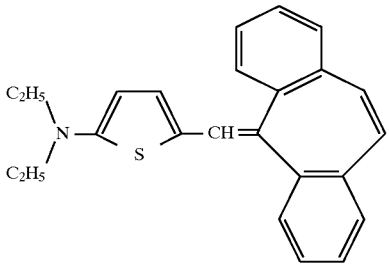

Styryl Compound (3)-16

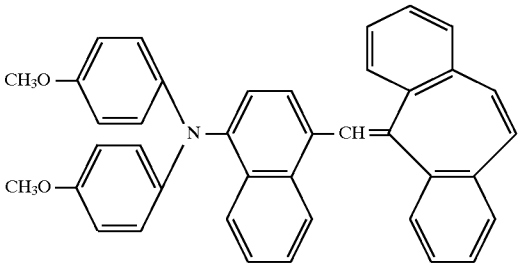

Among them, Styryl Compound (3)-10 is more preferable in view of sensitivity and compatibility with the resin set forth above. These styryl compounds can be synthesized by a process disclosed in, for example, Japanese Unexamined Patent Publication No. 63-225660.

The surface layer of the electrophotographic photosensitive member in accordance with the present invention can include either the triarylamine compound or compounds of general formula (2) or the styryl compound or compounds of formula (3). More preferably, the surface layer comprises at least one triarylamine compound represented by the general formula (2) and at least one styryl compound represented by the general formula (3) in order to prevent deposition of the charge transfer material.

When the photosensitive layer has a single-layer structure which contains both a charge generating material and a charge transfer material, the surface layer of the electrophotographic photosensitive layer in accordance with the present invention represents the photosensitive layer itself. When the photosensitive layer has a laminated structure consisting of a charge generating layer containing a charge generating material and a charge transfer layer containing a charge transfer material, the surface layer represents the charge transfer layer. In the present invention a laminated structure is preferable in view of electrophotographic characteristics.

The charge transfer layer can be formed by applying a solution containing the resin set forth above as a binder, at least one compound of the triarylamine compound and a styryl compound as a charge transfer material and an appropriate solvent to a substrate, followed by drying. The ratio of the charge transfer material and the binder preferably ranges from 1:0.5 to 1:2 by weight. The thickness of the charge transfer layer preferably ranges from 5 $\mu$m to 40 $\mu$m, and more preferably 15 $\mu$m to 30 $\mu$m.

The charge generating layer can be formed by applying and drying a dispersion containing a charge generating material, a binder and a solvent, in which the amount of the binder resin is 0.3 to 4 times the charge generating material. The dispersion is prepared by dispersing the charge generating material and the binder in the solvent with a homogenizer, an ultrasonic dispersion machine, a ball mill, a vibrational ball mill, a sand mill, an attritor, a roll mill or a liquid collision type high speed dispersion machine. Examples of charge generating materials used in the present invention include dyes, such as selenium-tellurium dyes, pyrylium dyes and thiapyrylium dyes; and pigments, such as phthalocyanine pigments, anthanthrone pigments, dibenzopyrenequinone pigments, trisazo pigments, cyanine pigments, disazo pigments, monoazo pigments, indigo pigments, quinacridone pigments, and asymmetric quinocyanine pigments. The thickness of the charge transfer layer preferably is not more than 5 $\mu$m, and more preferably ranges from 0.1 to 2 $\mu$m.

The surface layer in accordance with the present invention may contain an antioxidant and a lubricant.

Materials for use in the substrates in accordance with the present invention include conductive materials. Examples of such conductive materials include metals such as aluminum and stainless steel, metals, paper, and plastics provided with a conductive layer. These conductive materials may have a sheet or cylindrical shape.

In the present invention, a conductive layer may be provided between the substrate and the photosensitive layer in order to prevent interference band formation or to cover flaws on the substrate. Such a conductive layer can be formed by applying and drying a dispersion containing a conductive powder, such as carbon black or a particulate metal oxide, and a binding resin. The thickness of the conductive layer preferably ranges from 5 $\mu$m to 40 $\mu$m, and more preferably from 10 to 30 $\mu$m.

In the present invention, an interlayer having adhesiveness and barrier properties may be provided between the substrate and the photosensitive layer. Examples of the interlayer materials include polyamides, polyvinyl alcohol, polyethylene oxide, ethyl cellulose, casein, polyurethanes, and polyether urethanes. These materials may be applied as a solution in an appropriate solvent. The thickness of the interlayer preferably ranges from 0.05 $\mu$m to 5 $\mu$m, and more preferably 0.3 $\mu$m to 1 $\mu$m.

FIG. 1 is a schematic cross-sectional view of an electrophotographic apparatus provided with a process cartridge using an electrophotographic photosensitive member in accordance with the present invention.

In FIG. 1, an electrophotographic photosensitive member 1 in accordance with the present invention rotates along an axis 2 in the direction as shown by the arrow at a predetermined speed. The peripheral surface of the photosensitive member 1 is uniformly charged at a given negative or positive potential with a primary charging means 3 during rotation, and is then subjected to image exposure 4 by an exposure means (not shown in the drawing), such as a slit exposure, or a laser beam scanning exposure. A latent image is continuously formed on the peripheral surface of the photosensitive member 1.

The formed latent image is developed with a toner by a developing means 5 and the developed toner image is transferred to a recording material 7 by a transfer means 6. In the transfer means 6, the recording material is fed from a feeding section (not shown in the drawing) to a space between the photosensitive member 1 and the transfer means 6 in synchronism with the rotation of the photosensitive member 1. The toner image is transferred to recording material 7 from the surface of the photosensitive member 1. The recording material 7 is separated from the photosensitive member surface and conducted to an image fixing means 8. The transferred image on the recording material 7 is fixed by the image fixing means 8. The recording material 7 containing the fixed toner image is passed out of the apparatus as a copy.

The surface of the photosensitive member 1, after the image transfer, is cleaned with cleaning means 9 which removes the residual toner on the surface, is de-electrified by preliminary exposure light 10 from a preliminary exposing means (not shown in the drawing), and then is used for the next image formation. When the primary charging means 3 is a contact charging means using a charging roll or the like, the preliminary exposure light is not always necessary.

In the present invention, a plurality of the components selected from the group consisting of the photosensitive member 1, the primary charging means 3, the developing means 5 and the cleaning means 9 are integrated in a process cartridge, which can be loaded to and unloaded from the main body of an electrophotographic apparatus, e.g. a copying machine or a laser beam printer. For example, at least one component of the primary charging means 3, the developing means 5 and the cleaning means 9 is integrated with the photosensitive member 1 in process cartridge 11, and process cartridge 11 is loaded to and unloaded from the main body of the apparatus using a guiding means, e.g. rails 12 in the main body.

In FIG. 1, image exposure 4 represents reflected light or transmitted light from an original document, or light from a laser, LED or shutter array, driven by signals from the original document when the electrophotographic apparatus is a copying machine or a printer.

The present invention will now be illustrated in detail with reference to the following representative Examples which are not limitative of scope. In the Examples, "pbw" means "parts by weight".

EXAMPLES 1 THROUGH 12

On an aluminum cylinder of 30×254 mm, a paint based on the following formulation was applied by a dip coating process and cured at 140° C. for 30 minutes. A conductive layer having a thickness of 15 $\mu$m was formed.

| | |
|---|---|
| Conductive pigment: $SnO_2$ coated barium sulfate | 10 pbw |
| Pigment for adjusting resistance: titanium oxide | 2 pbw |
| Binder resin: phenol resin | 6 pbw |
| Leveling material: silicone oil | 0.001 pbw |
| Solvent: methanol/methoxypropanol (0.2/0.8) | 20 pbw |

A solution composed of 3 pbw of N-methoxymethylated nylon, 3 pbw of copolymeric nylon and a mixed solvent of 65 pbw of methanol and 30 pbw of n-butanol was coated on the resulting conductive layer by a dip coating process, followed by drying. An interlayer having a thickness of 0.5 $\mu$m was formed.

A dispersion was prepared by dispersing 4 pbw of oxytitanium phthalocyanine having strong X-ray (CuKα) diffraction peaks (2θ±0.2 degrees) at 9.0 degrees, 14.2 degrees, 23.9 degrees and 27.1 degrees and 2 pbw of polyvinyl butyral (Trade Name: S-LEC, made by Sekisui Chemical Co., Ltd.) into 60 pbw of cyclohexanone using a sand mill with 1-mm glass beads for 4 hours; and then adding 100 pbw of ethyl acetate. The dispersion was coated on the interlayer by a dip coating process, followed by drying. A charge generating layer having a thickness of 0.3 μm was formed.

Next, in each Example, 10 pbw of a charge transfer material listed in Table 1 and 10 pbw of a resin listed in Table 1 were dissolved into a mixed solvent of 30 pbw of monochlorobenzene and 70 pbw of dichloromethane. The resin was synthesized as follows: Bisphenol (0.01 mol), sodium hydroxide (0.8 g) and tetramethylammonium chloride (1 g) were dissolved into 100 ml water, and the resulting solution was placed into a 1-liter mixer. A solution formed of terephthalyl chloride (0.005 mol) and isophthalyl chloride (0.005 mol) dissolved in 1,2-dichloroethane (30 ml), was added to the mixer while stirring. The mixture was further stirred at a high speed for 10 minutes after the addition, and allowed to stand for 2 hours, thereby forming a 1,2-dichloroethane layer. Then, the 1,2-dichloroethane layer was transferred to a container and a large amount of hexane was added to the 1,2-dichloroethane solution to precipitate the resulting resin. After washing with water, the resin was purified by dissolving into chloroform and then precipitating again with methanol.

The solution containing the charge transfer material and the resin was coated on the charge generating layer by a dip coating process and dried at 120° C. for 2 hours. A charge transfer layer having a thickness of 25 μm was formed.

Each resulting electrophotographic photosensitive member was evaluated as follows:

The electrophotographic photosensitive member was loaded in a modified LBP "Laser Jet 4 Plus" made by Hewlett-Packard Company (process speed: 71 mm/sec). The modification involves constant voltage control of primary charging instead of a constant current control. The electrophotographic photosensitive member was subjected to continuous paper feeding test with the modified apparatus at 28° C. and 90% RH. An image used in the test was an A4 size grid pattern with a printing rate of 4%. The operation was performed by an intermittent mode stop per print. The copying operation was continued until fogging occurred by visual observation, while supplying toner. The number of repeated copying cycles was recorded as durability. Taber abrasion of a fresh electrophotographic photosensitive member was determined by means of weight loss during an abrasion test for 15 minutes using an abrasion tester made by Yasuda Seiki Seisakusho Co., Ltd. with an abrasion tape.

A photomemory value was determined as follows: A section of a fresh electrophotographic photosensitive member was irradiated with light from a white fluorescent lighting of 3000 Lux for 10 minutes, allowed to stand for 10 minutes, and then subjected to light portion potential measurement. The photomemory value was defined as a difference in light portion potential between the light irradiated section and the nonlight-irradiated section. The light portion potential was determined by measuring a surface potential when a solid black image was formed on the electrophotographic photosensitive member in the same LBP with a surface potentiometer.

Solvent crack resistance was determined as follows: Finger grease was adhered to the surface of a fresh electrophotographic photosensitive member, allowed to stand for 48 hours, then solvent crack formation was observed by microscopy. These results are set forth in Table 1.

TABLE 1

| | Resin | | | | Charge Transfer Material | | | | | | |
|---|---|---|---|---|---|---|---|---|---|---|---|
| | Structural Unit | | A/B (mole | Viscosity Average Molecular | Compound No. | | C/D (mole | Durability | Taber Abrasion | Photomemory | Solvent Crack |
| | A | B | ratio) | Weight | C | D | ratio) | (×10,000) | (mg) | (V) | Resistance |
| Example 1 | (1)-1 | (1)-2 | 70/30 | 30,000 | (2)-6 | — | 100/0 | 3.7 | 0.5 | 45 | No cracks |
| Example 2 | (1)-1 | (1)-2 | 50/50 | 32,000 | (2)-6 | (3)-10 | 70/30 | 3.4 | 0.6 | 40 | No cracks |
| Example 3 | (1)-1 | (1)-2 | 90/10 | 33,000 | (2)-6 | (2)-4 | 70/30 | 3.5 | 0.5 | 45 | No cracks |
| Example 4 | (1)-5 | — | 100/0 | 31,000 | (2)-13 | — | 100/0 | 2.1 | 1.1 | 45 | No cracks |
| Example 5 | (1)-1 | (1)-7 | 80/20 | 30,000 | (2)-6 | (2)-4 | 70/30 | 2.8 | 0.8 | 40 | No cracks |
| Example 6 | (1)-1 | (1)-8 | 70/30 | 30,000 | (2)-6 | (2)-13 | 70/30 | 2.6 | 0.9 | 45 | No cracks |
| Example 7 | (1)-6 | — | 100/0 | 28,000 | (2)-13 | (2)-4 | 70/30 | 2.6 | 0.8 | 40 | No cracks |
| Example 8 | (1)-1 | (1)-2 | 25/75 | 23,000 | (2)-13 | (3)-10 | 70/30 | 3.4 | 0.6 | 45 | No cracks |
| Example 9 | (1)-1 | (1)-3 | 70/30 | 20,000 | (2)-6 | (2)-4 | 90/10 | 2.8 | 0.8 | 40 | No cracks |
| Example 10 | (1)-1 | — | 100/0 | 35,000 | (2)-6 | (3)-10 | 90/10 | 3.6 | 0.5 | 45 | No cracks |
| Example 11 | (1)-4 | — | 100/0 | 32,000 | (2)-13 | (3)-10 | 50/50 | 3.4 | 0.9 | 40 | No cracks |
| Example 12 | (1)-1 | (1)-9 | 50/50 | 33,000 | (3)-10 | — | 100/0 | 2.5 | 1.0 | 45 | No cracks |
| Example 13 | (1)-1 | — | 100/0 | 33,000 | (2)-6 | — | 100/0 | 3.7 | 0.5 | 45 | No cracks |
| Example 14 | (1)-1 | — | 100/0 | 30,000 | (2)-6 | (2)-4 | 70/30 | 3.5 | 0.6 | 45 | No cracks |
| Example 15 | (1)-1 | — | 100/0 | 28,000 | (2)-6 | (3)-10 | 70/30 | 3.1 | 0.6 | 40 | No cracks |

Comparative Examples 1 through 5

Electrophotographic photosensitive members were prepared as in Example 1, except that compounds set forth in Table 2 were used as resins and charge transfer materials for charge transfer layers, and evaluated. The Structural Units 1 through 3 and Comparative Compound 1 in Table 2 have the following structures:

Structural Unit CE-1:

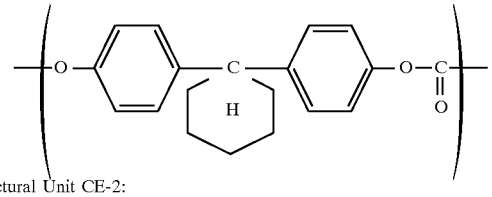

Structural Unit CE-2:

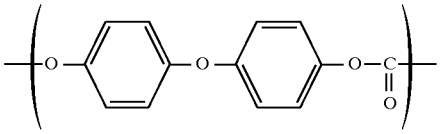

Structural Unit CE-2

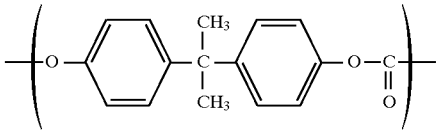

Comparative Compound CC-1

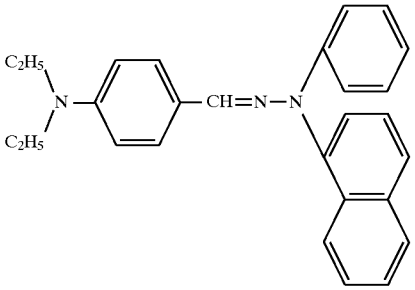

Results are set forth in Table 2. Image defects due to flaws formed on the surface of the electrophotographic photosensitive member were observed after 6,000 copying cycles during a durability test in Comparative Example 1, and after 2,000 copying cycles in Comparative Example 4.

equivalent arrangements, included within the spirit and scope of the appended claims. The scope of the following claims is to be accorded the broadest interpretation so as to encompass all such modifications and equivalent structures and functions.

What is claimed is:

1. An electrophotographic photosensitive member comprising: a substrate and a photosensitive layer formed thereon, a surface layer of said photosensitive layer containing (a) a resin comprising a structural unit represented by the following general formula (1), and (b) at least one compound of (i) a triarylamine compound represented by the following general formula (2) or (ii) a styryl compound represented by the following general formula (3):

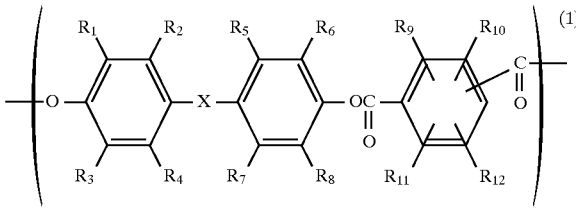

(1)

wherein, X is $—CR_{13}R_{14}—$, substituted or unsubstituted cycloalkylidene, substituted or unsubstituted α,ω-alkylene, single bond, —O—, —S—, —SO— or $—SO_2—$, wherein $R_{13}$ and $R_{14}$ are each hydrogen, trifluoromethyl, or substituted or unsubstituted alkyl or aryl and are the same or different, and $R_1$ to $R_{12}$ are each hydrogen, halogen, or substituted or unsubstituted alkyl or aryl, and are the same or different;

TABLE 2

| | Resin | | | | | | | | | | |
|---|---|---|---|---|---|---|---|---|---|---|---|
| | | | | Viscosity | Charge Transfer Material | | | | | | |
| | Structural Unit | | A/B (mole | Average Molecular | Compound No. | | C/D (mole | Durability | Taber Abrasion | Photomemory | Solvent Crack |
| | A | B | ratio) | Weight | C | D | ratio) | (×10,000) | (mg) | (V) | Resistance |
| Comparative Example 1 | (1)-1 | — | 100/0 | 32,000 | CC-1 | — | 100/0 | 1.8 | 1.8 | 45 | Cracks Observed |
| Comparative Example 2 | CE-1 | — | 100/0 | 48,000 | CC-1 | — | 100/0 | 1.0 | 2.5 | 60 | Cracks Observed |
| Comparative Example 3 | CE-2 | CE-3 | 50/50 | 45,000 | (3)-10 | — | 100/0 | 0.5 | 3.3 | 75 | No cracks |
| Comparative Example 4 | CE-3 | — | 100/0 | 50,000 | (3)-10 | — | 100/0 | 0.2 | 2.9 | 65 | Cracks Observed |
| Comparative Example 5 | CE-1 | — | 100/0 | 45,000 | (2)-13 | (2)-4 | 70/30 | 1.2 | 2.4 | 65 | Cracks Observed |

While the present invention has been described with reference to what are presently considered to be the preferred embodiments, it is to be understood that the invention is not limited to the disclosed embodiments. To the contrary, the invention is intended to cover various modifications and (2)

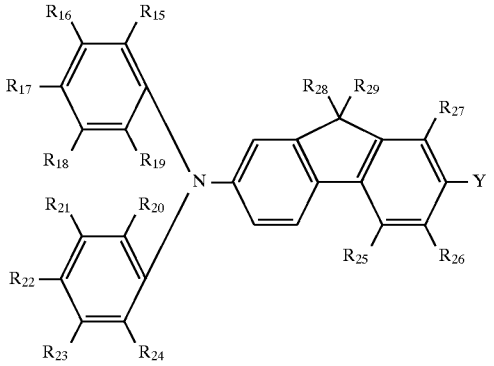

wherein Y is hydrogen, halogen, substituted or unsubstituted alkyl or alkoxy, or

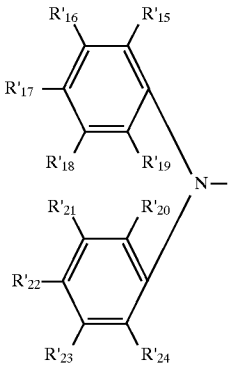

wherein $R_{15}'$ to $R_{24}'$ are each hydrogen, halogen, substituted or unsubstituted alkyl or alkoxy and are the same or different, $R_{15}$ to $R_{27}$ are each hydrogen, halogen, substituted or unsubstituted alkyl or alkoxy and are the same or different, and $R_{28}$ and $R_{29}$ are each hydrogen or substituted or unsubstituted alkyl, aralkyl or aryl, and are the same or different;

(3)

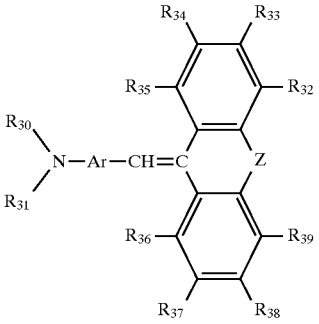

wherein Z is —$CH_2CH_2$— or —CH═CH—, $R_{30}$ and $R_{31}$ are each substituted or unsubstituted alkyl, aralkyl, aryl or heterocyclic and are the same or different, $R_{32}$ to $R_{39}$ are each hydrogen, substituted or unsubstituted alkyl or alkoxy and are the same or different, and Ar is substituted or unsubstituted arylene or heterocyclic.

2. An electrophotographic photosensitive member according to claim 1, wherein X is cycloalkylidene having 5 to 11 carbon atoms, or α,ω-alkylene having 2 to 10 carbon atoms.

3. An electrophotographic photosensitive member according to claim 1, wherein said structural unit represented by the general formula (1) has the following formula:

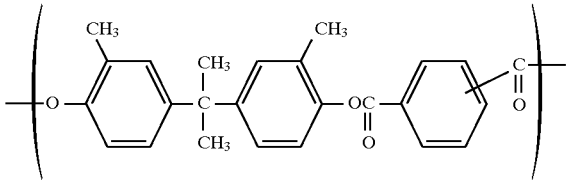

4. An electrophotographic photosensitive member according to claim 1, wherein said surface layer contains both said triarylamine compound represented by the general formula (2) and said styryl compound represented by the general formula (3).

5. An electrophotographic photosensitive member according to claim 4, wherein said triarylamine compound and said styryl compound are represented by the following formulae:

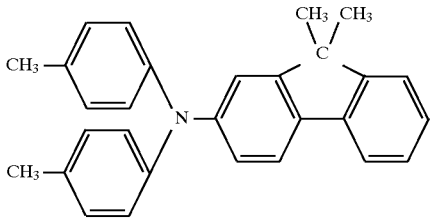

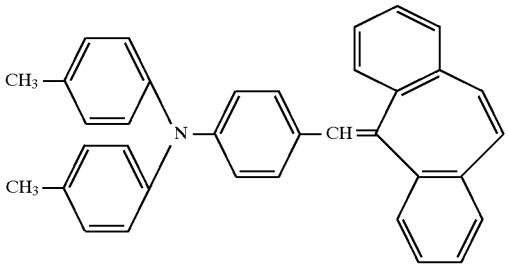

6. An electrophotographic photosensitive member according to claim 5, wherein said structural unit represented by the general formula (1) has the following formula:

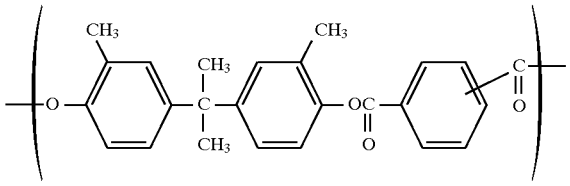

7. An electrophotographic photosensitive member according to claim 5, wherein said photosensitive layer comprises a charge generating layer and a charge transfer layer, and said charge generating layer is said surface layer.

8. A process cartridge, comprising: an electrophotographic photosensitive member and at least one means selected from the group consisting of a charging means, a developing means and a cleaning means, said electrophotographic photosensitive member and said at least one means being integrally supported and detachable from an electrophotographic apparatus main body, said electrophotographic photosensitive member comprising a substrate and a photosensitive layer formed thereon, a surface layer of said photosensitive layer containing (a) a resin comprising a structural unit represented by the following general formula (1), and (b) at least one compound of (i) a triarylamine compound represented by the following general formula (2) or (ii) a styryl compound represented by the following general formula (3):

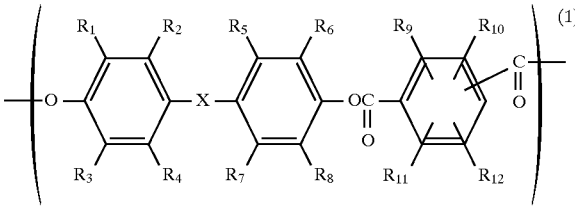

(1)

wherein, X is —$CR_{13}R_{14}$—, substituted or unsubstituted cycloalkylidene, substituted or unsubstituted α,ω-alkylene, single bond, —O—, —S—, —SO— or —$SO_2$—, wherein $R_{13}$ and $R_{14}$ are each hydrogen, trifluoromethyl, or substituted or unsubstituted alkyl or aryl and are the same or different, and $R_1$ to $R_{12}$ are each hydrogen, halogen, or substituted or unsubstituted alkyl or aryl, and are the same or different;

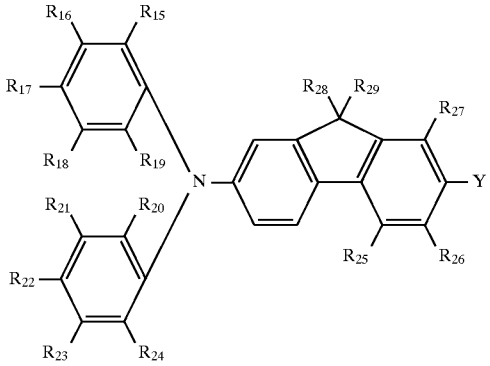

(2)

wherein Y is hydrogen, halogen, substituted or unsubstituted alkyl or alkoxy, or

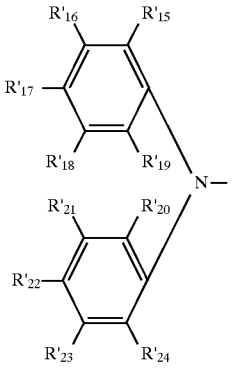

wherein $R_{15}'$ to $R_{24}'$ are each hydrogen, halogen, substituted or unsubstituted alkyl or alkoxy and are the same or different, $R_{15}$ to $R_{27}$ are each hydrogen, halogen, substituted or unsubstituted alkyl or alkoxy and are the same or different, and $R_{28}$ and $R_{29}$ are each hydrogen or substituted or unsubstituted alkyl, aralkyl or aryl, and are the same or different;

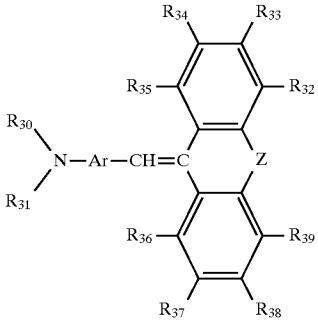

(3)

wherein Z is —$CH_2CH_2$— or —CH═CH—, $R_{30}$ and $R_{31}$ are each substituted or unsubstituted alkyl, aralkyl, aryl or heterocyclic and are the same or different, $R_{32}$ to $R_{39}$ are each hydrogen, substituted or unsubstituted alkyl or alkoxy and are the same or different, and Ar is substituted or unsubstituted arylene or heterocyclic.

9. An electrophotographic apparatus, comprising: an electrophotographic photosensitive member, a charging means, an exposure means, a developing means and a cleaning means, said electrophotographic photosensitive member comprising a substrate and a photosensitive layer formed thereon, a surface layer of said photosensitive layer containing (a) a resin comprising a structural unit represented by the following general formula (1), and (b) at least one compound of (i) a triarylamine compound represented by the following general formula (2) or (ii) a styryl compound represented by the following general formula (3):

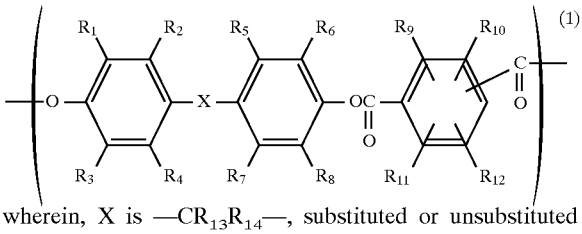

(1)

wherein, X is —$CR_{13}R_{14}$—, substituted or unsubstituted cycloalkylidene, substituted or unsubstituted α,ω-alkylene, single bond, —O—, —S—, —SO— or —$SO_2$—, wherein $R_{13}$ and $R_{14}$ are each hydrogen, trifluoromethyl, or substituted or unsubstituted alkyl or aryl and are the same or different, and $R_1$ to $R_{12}$ are each hydrogen, halogen, or substituted or unsubstituted alkyl or aryl, and are the same or different;

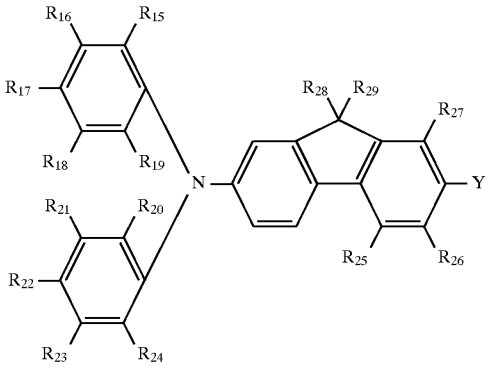

(2)

wherein Y is hydrogen, halogen, substituted or unsubstituted alkyl or alkoxy, or

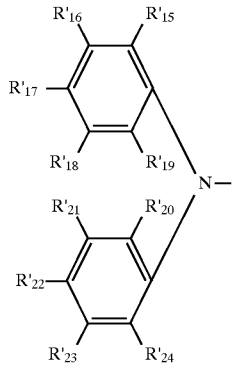

wherein $R_{15}'$ to $R_{24}'$ are each hydrogen, halogen, substituted or unsubstituted alkyl or alkoxy and are the same or different, $R_{15}$ to $R_{27}$ are each hydrogen, halogen, substituted or unsubstituted alkyl or alkoxy and are the same or different, and $R_{28}$ and $R_{29}$ are each hydrogen or substituted or unsubstituted alkyl, aralkyl or aryl, and are the same or different;

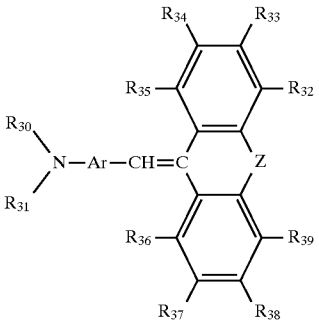

(3)

wherein Z is $—CH_2CH_2—$ or —CH=CH—, $R_{30}$ and $R_{31}$ are each substituted or unsubstituted alkyl, aralkyl, aryl or heterocyclic and are the same or different, $R_{32}$ to $R_{39}$ are each hydrogen, substituted or unsubstituted alkyl or alkoxy and are the same or different, and Ar is substituted or unsubstituted arylene or heterocyclic.

* * * * *